US009458704B2

(12) United States Patent
Al-Mulhem et al.

(10) Patent No.: US 9,458,704 B2
(45) Date of Patent: Oct. 4, 2016

(54) OIL WELL GAS LIFT BY HYDROGEN PRODUCTION THROUGH PRODUCED WATER ELECTROLYSIS COMPLETION

(71) Applicant: Saudi Arabian Oil Company, Dhahran (SA)

(72) Inventors: Abdulrahman Abdulaziz Al-Mulhem, Dhahran (SA); Mohamed Nabil Noui-Mehidi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 142 days.

(21) Appl. No.: 14/337,398

(22) Filed: Jul. 22, 2014

(65) Prior Publication Data

US 2015/0027722 A1 Jan. 29, 2015

Related U.S. Application Data

(60) Provisional application No. 61/858,700, filed on Jul. 26, 2013.

(51) Int. Cl.
*E21B 43/12* (2006.01)

(52) U.S. Cl.
CPC ..... *E21B 43/122* (2013.01)

(58) Field of Classification Search
CPC .. E21B 43/16; E21B 43/2401; E21B 43/122; B01J 19/0013; C02F 1/20; C25B 1/02; C25B 1/04
See application file for complete search history.

(56) References Cited

U.S. PATENT DOCUMENTS

| | | | | |
|---|---|---|---|---|
| 1,784,214 | A | 12/1930 | Workman | |
| 2,799,641 | A * | 7/1957 | Bell | E21B 43/16 166/248 |
| 3,417,823 | A * | 12/1968 | Faris | E21B 43/16 166/248 |
| 3,724,543 | A | 4/1973 | Bell et al. | |
| 3,782,465 | A | 1/1974 | Bell et al. | |
| 4,037,655 | A | 7/1977 | Carpenter | |
| 4,199,025 | A | 4/1980 | Carpenter | |
| 4,204,923 | A * | 5/1980 | Carpenter | C10G 1/00 205/335 |
| 4,233,132 | A | 11/1980 | Carr et al. | |
| 4,919,201 | A * | 4/1990 | Bridges | C23F 13/04 166/60 |

(Continued)

OTHER PUBLICATIONS

PCT International Search Report and the Written Opinion; dated Mar. 19, 2015; International Application No. PCT/US2014/047370; International File Date: Jul. 21, 2014.

*Primary Examiner* — Daniel P Stephenson
(74) *Attorney, Agent, or Firm* — Bracewell LLP; Constance Gall Rhebergen

(57) ABSTRACT

A method of using an electrochemical gas lift apparatus to induce artificial gas lift in a production fluid includes introducing the electrochemical gas lift apparatus into a well bore having a production zone, operating the electrochemical gas lift apparatus such that a combination of hydrocarbon fluid and formation water is introduced into the interior of the electrochemical gas lift apparatus, introducing electrical power to the electrochemical gas lift apparatus such that at least a portion of formation water in the interior of the electrochemical gas lift apparatus converts into product gases, operating the electrochemical gas lift apparatus such that the product gases form product gas bubbles in the interior of the electrochemical gas lift apparatus, and operating the electrochemical gas lift apparatus such that production fluid forms in the interior of the electrochemical gas lift apparatus. The production fluid comprises hydrocarbon fluid, unconverted formation water and product gas bubbles.

13 Claims, 3 Drawing Sheets

(56) References Cited

U.S. PATENT DOCUMENTS

| | | | | |
|---|---|---|---|---|
| 5,452,763 | A | 9/1995 | Owen | |
| 7,325,604 | B2 * | 2/2008 | Wittle | E21B 43/2401 166/248 |
| 8,002,969 | B2 | 8/2011 | Hamad | |
| 8,156,954 | B2 * | 4/2012 | Tao | F17D 1/16 137/13 |
| 8,364,287 | B2 | 1/2013 | Pearson et al. | |
| 9,222,341 | B2 * | 12/2015 | Noui-Mehidi | E21B 43/122 |
| 2005/0098443 | A1 | 5/2005 | Gomez | |
| 2007/0000841 | A1 * | 1/2007 | Harrington | B09C 1/002 210/703 |
| 2013/0105174 | A1 | 5/2013 | Noui-Mehidi | |
| 2013/0118735 | A1 | 5/2013 | Jamal et al. | |
| 2015/0027722 | A1 * | 1/2015 | Al-Mulhem | E21B 43/122 166/372 |

* cited by examiner

OIL WELL GAS LIFT BY HYDROGEN PRODUCTION THROUGH PRODUCED WATER ELECTROLYSIS COMPLETION

CROSS-REFERENCE TO RELATED PATENT APPLICATIONS

This application claims priority from U.S. Provisional Application No. 61/858,700, filed Jul. 26, 2013. For purposes of United States patent practice, this application incorporates the contents of the Provisional Application by reference in its entirety.

BACKGROUND OF THE INVENTION

1. Field of the Invention

The field of invention relates to providing artificial lift to a well producing hydrocarbon fluid. More specifically, the field relates to providing artificial lift using an electrochemical gas lift apparatus, method of use, and system.

2. Description of the Related Art

In drilling long, horizontal wells, the well bore traversing through the hydrocarbon-bearing formation encounters areas where the porosity and conductivity is not homogenous. The hydrocarbon-bearing formation can include areas of greater permeability that conduct water through the formation at a greater rate towards a production point than hydrocarbons can traverse generally through the formation.

Well completion systems are located within the well bore proximate to the sand face where extraction of production fluid occurs. Well completion systems have inflow control devices (ICDs) with inflow control valves (ICVs) as a means for controlling the rate of fluid production. The ICDs ensure that greater permeability areas do not support bypassing of a zone of hydrocarbon fluid and permit premature water breakthrough. Tuning the fluid draw through each ICD by regulating the position of the ICV or other means, including modifying the properties of an inlet flow labyrinth or other mechanical restrictions, may reduce any differences in formation properties across a series of production zones such that water breakthrough is mitigated.

Regardless of mechanically restricting production fluid inlet rate to mitigate the effects of "coning" or "fingering" of water through hydrocarbons in the hydrocarbon-bearing formation, aging oil fields still face the challenge of producing "wet oil". Wet oil is the colloquial term for crude oil or condensate that has formation water entrained in it. In most cases, the material produced from a well is not all hydrocarbons. This "water cut" reduces the efficiency and effectiveness of the production system by bringing formation water to the surface.

SUMMARY OF THE INVENTION

A method of using an electrochemical gas lift apparatus to induce artificial gas lift in a production fluid includes introducing the electrochemical gas lift apparatus into a well bore such that the electrochemical gas lift apparatus is located in the production zone of the well bore. The well bore is defined by a well bore wall and traverses the hydrocarbon-bearing formation. The production zone contains a well bore fluid comprising hydrocarbon fluid and formation water. The method includes operating the electrochemical gas lift apparatus such that the well bore fluid is introduced into an interior of the electrochemical gas lift apparatus. The method includes introducing electrical power to the electrochemical gas lift apparatus such that a portion of the formation water in the well bore fluid in the interior of the electrochemical gas lift apparatus is converted into product gas, where the product gas includes hydrogen gas and oxygen gas. The method includes operating the electrochemical gas lift apparatus such that the product gas forms product gas bubbles and the production fluid forms. The production fluid comprises hydrocarbon fluid, unconverted formation water and product gas bubbles. The product gas bubbles induce artificial gas lift in the production fluid.

A method of using an electrochemical gas lift system to produce electrical power from a production fluid includes the steps from a method of using an electrochemical gas lift apparatus to induce artificial gas lift in a production fluid. The method also includes operating the electrochemical gas lift system such that the production fluid is produced and introduced into a separation system. A reactive gas is selectively separated from the production fluid in the separation system. The reactive gas is introduced into an electrical generation system. Electrical power is produced from the reactive gas in the electrical generation system. At least a portion of the produced electrical power is introduced to the electrochemical gas lift apparatus.

A completion string that is operable to provide artificial lift to the production fluid from the production zone to the surface within the completion string includes an internal fluid conduit within the completion string. The internal fluid conduit is operable to convey the production fluid from the production zone to the surface. The completion string also includes an electrochemical gas lift apparatus. The electrochemical gas lift apparatus includes an anode, a cathode and an interior wall. The interior wall defines an interior that contains both the anode and the cathode and that is operable as part of the internal fluid conduit of the completion string to convey production fluid. The apparatus is operable to selectively permit the introduction of the well bore fluid from the production zone into the interior. The well bore fluid comprises hydrocarbon fluid and formation water. The apparatus is operable to convert formation water at the anode and the cathode using electrical power into product gas, to convert product gas into product gas bubbles and to convert the introduced well bore fluid into the production fluid. Production fluid includes hydrocarbon fluid, unconverted formation water and product gas bubbles. The production fluid is artificially lifted by the presence of the product gas bubbles.

Electrolysis is the passage of an electrical current through an electrolyte and migration of disassociated charged ions to opposite-charged electrodes. Electrolysis of an electrically conductive aqueous solution, including formation water and brines, produces hydrogen gas at the cathode and oxygen at the anode of the electrochemical cell. The electrochemical gas lift apparatus is operable as an electrolysis cell on the introduced formation water. The formation water contains salts and minerals, which are electrically conductive in the aqueous solution. The reduction-oxidation reaction that occurs during electrolysis inside the electrochemical cell portion of the electrochemical gas lift apparatus produces the product gas. Product gas bubbles form from aggregated product gas on the electrodes. The product gas bubbles, the hydrocarbon fluid and the unconverted formation water form the production fluid.

The product gas bubbles provide artificial lift to the production fluid. The product gas bubbles generated downhole expand as they rise. Due to the pressure difference between the surface and downhole, the volume of product gas generated downhole to achieve artificial lift is less relative to the volume of gas obtained at the surface for compression and transport down to the distal end of the well bore to achieve a similar result. Therefore, it is more efficient to generate artificial lift gas downhole than transport the gas downhole.

The electrochemical gas lift system, apparatus and method uses a combination of electrical power and formation water to form the product gas. Using formation water eliminates a portion of the formation water at the source that otherwise is conveyed to the surface. Formation water at the surface requires separation and disposal. Instead, the formation water is a source of raw material for producing product gas.

Artificial lift is mechanical in nature. As the product gas bubbles traverse upwards as part of the production fluid, the hydrostatic pressure on the gas bubbles decreases. As the fluid pressure deceases the volume of the gas bubbles increases. The expanding gas bubbles push against the rest of the production fluid. This expansion reduces the fluid density of the production fluid that is uphole. Lower density of production fluid uphole reduces the head pressure on the fluid downhole. Lower head pressure per nits greater hydrocarbon fluid and formation water production from the hydrocarbon-bearing formation.

The electrochemical gas lift system separates the product gas and other light gases from the hydrocarbon fluid in the separation system. These separated reactive gas are useful for generating electrical power. The electrical power generated is useful for reintroduction into the electrochemical gas lift system to generate lift, other local applications and for delivery to a coupled power grid for transmission off-site.

BRIEF DESCRIPTION OF THE DRAWINGS

These and other features, aspects, and advantages of the present invention are better understood with regard to the following Detailed Description of the Preferred Embodiments, appended Claims, and accompanying Figures, where:

FIGS. 1-2 and their description facilitate a better understanding of the electrochemical gas lift apparatus and system. In no way should FIGS. 1-2 limit or define the scope of the invention. FIGS. 1-2 are simple diagrams for ease of description.

DETAILED DESCRIPTION OF THE PREFERRED EMBODIMENTS

Figure 1:
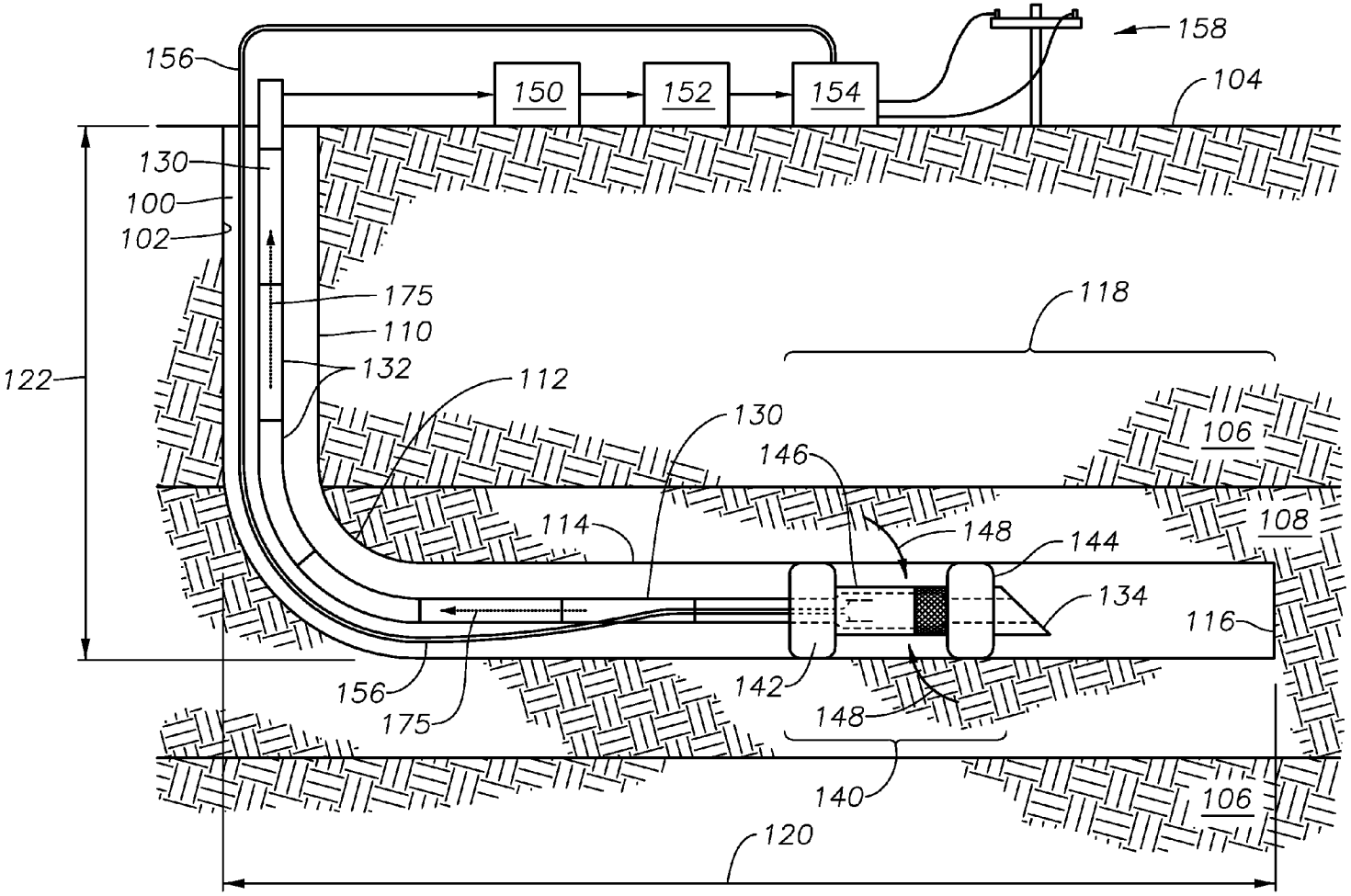
FIG. 1 shows an embodiment of an electrochemical gas lift system with an embodiment of an electrochemical gas lift apparatus in use in a horizontal well.

The Specification, which includes the Summary of invention, Brief Description of the Drawings and the Detailed Description of the Preferred Embodiments, and the appended Claims refer to particular features (including process or method steps) of the invention. Those of skill in the art understand that the invention includes all possible combinations and uses of particular features described in the Specification. Those of skill in the art understand that the invention is not limited to or by the description of embodiments given in the Specification. The inventive subject matter is not restricted except only in the spirit of the Specification and appended Claims.

Those of skill in the art also understand that the terminology used for describing particular embodiments does not limit the scope or breadth of the invention. In interpreting the Specification and appended Claims, all terms should be interpreted in the broadest possible manner consistent within the context of each term. All technical and scientific terms used in the Specification and appended Claims have the same meaning as commonly understood by one of ordinary skill in the art to which the invention belongs unless defined otherwise.

As used in the Specification and appended Claims, the singular forms "a", "an" and "the" include plural references unless the context clearly indicates otherwise. The verb "comprises" and its conjugated forms should be interpreted as referring to elements, components or steps in a non-exclusive manner, and the invention illustrative disclosed suitably may be practiced in the absence of any element which is not specifically disclosed, including as "consisting essentially of" and "consisting of. The referenced elements, components or steps may be present, utilized or combined with other elements, components or steps not expressly referenced. The verb "couple" and its conjugated forms means to complete any type of required junction, including electrical, mechanical or fluid, to form a singular object from two or more previously non-joined objects. If a first device couples to a second device, the connection can occur either directly or through a common connector. "Optionally" and its various forms means that the subsequently described event or circumstance may or may not occur. The description includes instances where the event or circumstance occurs and instances where it does not occur. "Operable" and its various forms means fit for its proper functioning and able to be used for its intended use. "Associated" and its various forms means something connected with something else because they occur together or that one produces the other. "Detect" and its conjugated forms should be interpreted to mean the identification of the presence or existence of a characteristic or property. "Fluids" means vapors, liquids, gases and their combinations at their present condition.

Spatial terms describe the relative position of an object or a group of objects relative to another object or group of objects. The spatial relationships apply along vertical and horizontal axes. Orientation and relational words, including "upstring" and "downstring", "uphole" and "downhole"; "upstream" and "downstream" and other like terms are for descriptive convenience and are not limiting unless otherwise indicated.

Where the Specification or the appended Claims provide a range of values, it is understood that the interval encompasses each intervening value between the first limit and the second limit as well as the first limit and the second limit. The invention encompasses and bounds smaller ranges of the interval subject to any specific exclusion provided.

Where the Specification and appended Claims reference a method comprising two or more defined steps, the defined steps can be carried out in any order or simultaneously except where the context excludes that possibility.

FIG. 1

FIG. 1 shows an embodiment of an electrochemical gas lift system with an embodiment of an electrochemical gas lift apparatus in use in a horizontal well. Horizontal well bore 100 is defined by well bore wall 102. Horizontal well bore 100 forms a pathway for equipment and tools that traverses from surface 104, through non-hydrocarbon bearing formation 105 to hydrocarbon-bearing formation 108. Horizontal well bore 100 has several sections, including vertical run 110, transition zone 112 and horizontal section 114. Horizontal section 114 extends in a generally horizontal direction from transition zone 112 until reaching the distal end (well bore face 116) of horizontal well bore 100 in relation to surface 104. Horizontal section 114 includes production zone 118, the location where hydrocarbon-bearing formation 108 is operable to produce the well bore fluid. The well bore fluid is a composition that includes hydrocarbon fluid and formation water and is in the production zone. Horizontal well bore 100 has a horizontal run length 120 that is much longer than its total vertical depth (TVD) 122.

FIG. 1 also shows completion string 130 previously introduced into horizontal well bore 100. The connected segments of production tubing 132 comprise most of completion string 130 and acts as a fluid conduit between surface 104 and horizontal well bore 100. Coupled to the leading end of completion string 130 is mule toe 134, which acts as a blunt guide for introduction and positioning of completion string 130 downhole.

Completion assembly 140 is proximate to the leading end of completion string 1130 and couples as part of production tubing 132. Completion assembly 140 includes uphole inflatable packer 142 and downhole inflatable packer 144. FIG. 1 shows both uphole inflatable packer 142 and downhole inflatable packer 144 inflated and frictionally coupling to well bore wall 102. inflation of uphole inflatable packer 142 and downhole inflatable packer 144 operates to both secure the position of completion assembly 140 and seal against fluid bypass of uphole inflatable packer 142 and downhole inflatable packer 144 between the isolated portion of production zone 118 and the remainder of horizontal well bore 100. Uphole inflatable packer 142 and downhole inflatable packer 144 are operable to both inflate and deflate based upon command from the surface.

Completion assembly 140 includes electrochemical gas lift apparatus 146. FIG. 1 shows electrochemical gas lift apparatus 146 coupling to both uphole inflatable packer 142 and downhole inflatable packer 144 such that the internal fluid conduit of completion string 130 is continuous through completion assembly 140. Electrochemical gas lift apparatus 146 is shown located in production zone 118 of horizontal well bore 100.

Electrochemical gas lift apparatus 146 is operable to permit selectively the introduction of well bore fluid into the interior of electrochemical gas lift apparatus 146 and into completion string 130. Upon initiating production, completion string 130 draws well bore fluid from hydrocarbon-bearing formation 108, into production zone 118 between uphole inflatable packer 142 and downhole inflatable packer 144 (arrows 148) and into electrochemical gas lift apparatus 146. Electrochemical gas lift apparatus 146 is an inflow control device.

Electrochemical gas lift apparatus 146 is operable to produce product gas bubbles from the formation water using electrical power. Converting at least a portion of the formation water into product gas, which in turn forms product gas bubbles, also leads to the formation of the production fluid. The production fluid comprises hydrocarbon fluid, the unconverted formation water, if any, and the product gas bubbles. The product gas bubbles provide the artificial gas lift to the production fluid in completion string 130 as it flows towards surface 104 (arrows 175).

In embodiments of the method, surface systems associated with producing the production fluid are operable to process portions of the produced production fluid to generate electrical power. Completion string 130 at surface 104 couples to separations facility 150. Separations facility 150 is operable to receive the production fluid, to selectively separate both the product gas as well as other gas from the production fluid to form a reactive gas. The reactive gas may contain, besides hydrogen and oxygen from the product gas, light hydrocarbons, carbon oxides and hydrogen sulfide, depending on the means for producing electrical power at electrical generation facility 152.

As shown in FIG. 1, electrical generation facility 152, which is located downstream of and couples to separations facility 150, is operable to receive the reactive gas from separations facility 150 and to produce electrical power using the introduced reactive gas. The produced electrical power is useful for supplying electrochemical gas lift apparatus 146 with power to generate artificial lift. Wellhead electrical control system 154 couples to electrical generation facility 152, electrical grid 158 and electrochemical gas lift apparatus 146. Wellhead electrical control system 154 is operable to direct electrical power into electrochemical gas lift apparatus 146 through power conduit 156. Power conduit 156 runs from surface 104 to production zone 118, traverses uphole inflatable packer 142 and couples to electrochemical gas lift apparatus 146. Power conduit 156 is operable to convey power from wellhead electrical control system 15.4 to electrochemical gas lift apparatus 146. Electrochemical gas lift apparatus 146 is operable to receive the electrical power. Electrical grid 158 is operable to receive any electrical power not used by the artificial lifting operation for distribution to locations off-site.

FIG. 2

Figure 2:
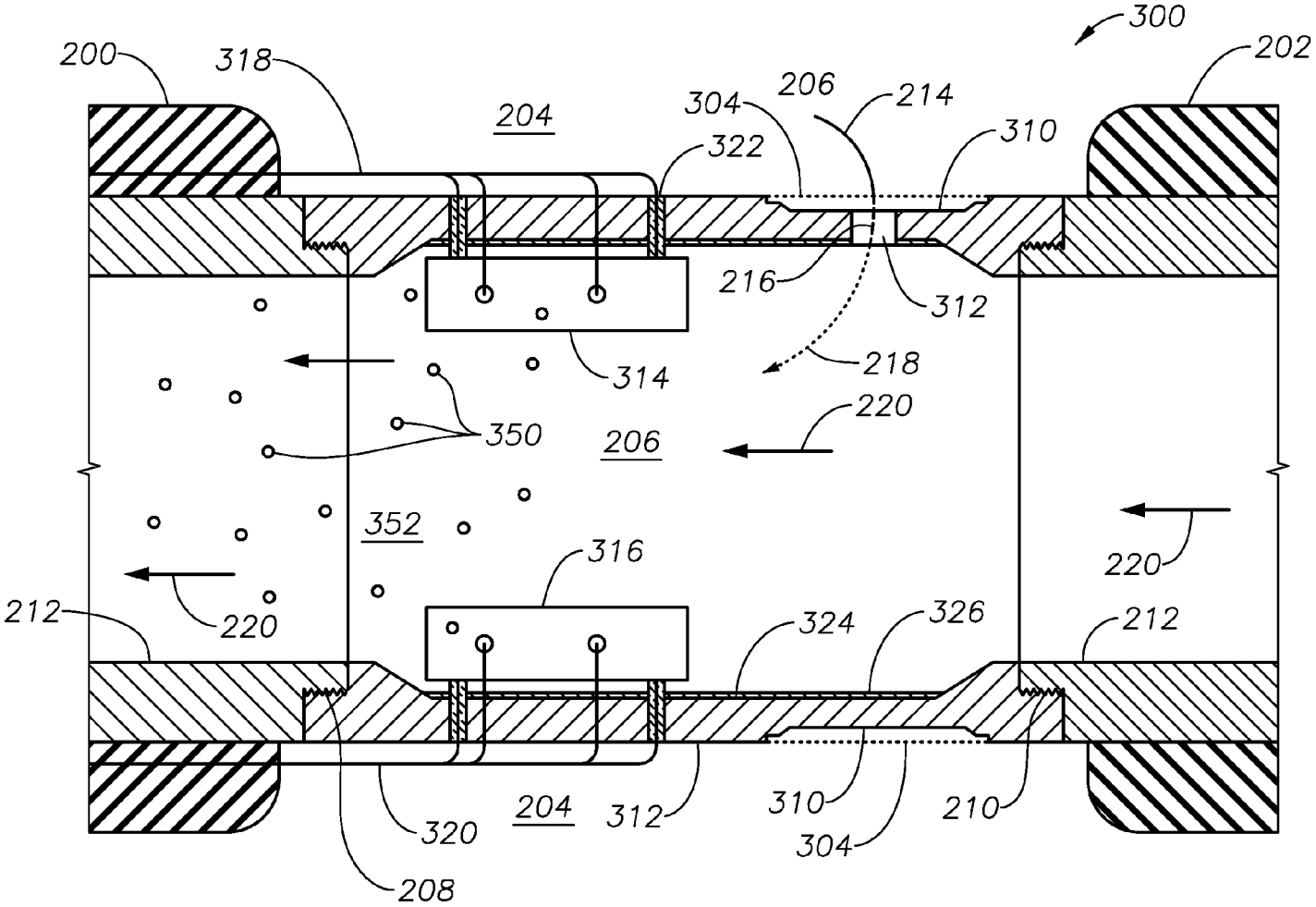
FIG. 2 shows an embodiment of an electrochemical gas lift apparatus in use in a horizontal well.

FIG. 2 shows an embodiment of the electrochemical gas lift apparatus in use in a horizontal well. FIG. 2 shows electrochemical gas lift apparatus 300 coupled to and located downstring from upstream packer 200 and coupled to and located upstring from downstream packer 202. Upstream packer 200 and downstream packer 202 isolate a portion of production zone 204 such that well bore fluid 206 is in between upstream packer 200 and downstream packer 202 and external to electrochemical gas lift apparatus 300 in production zone 204. Well bore fluid 206 contains both hydrocarbon fluid and formation water. Upstream packer 200 and downstream packer 202 both couple with electrochemical gas lift apparatus 300 using screw coupling 208 and screw coupling 210, respectively, to not only mechanically connect to electrochemical gas lift apparatus 300 to upstream packer 200 and downstream packer 202, respectively, but also to form common internal fluid conduit 212.

A hard and solid exterior cover 302 protects a portion of the exterior of electrochemical gas lift apparatus 300. The remaining portion is mesh sand screen 304. Well bore fluid 206 flows from production zone 204 (solid arrow 214), passes through mesh sand screen 304 into fluid collection recess 310 beneath mesh sand screen 304 (dashed arrow 216) and passes through inflow control valve 312 into the interior of electrochemical gas lift apparatus 300 (dotted arrow 218). Mesh sand screen 304 prevents sand and other fine particles from entering the interior of electrochemical gas lift apparatus 300. Sand and wellbore particles can erode the interior of the production tubing and upstring devices. Inflow control valve 312 selectively permits flow into the interior of electrochemical gas lift apparatus 300. Managing the position of inflow control valve 312 (closed, open, throttled) based upon the conditions present in production zone 204, including the amount of formation water present in well bore fluid 206, permits the control of formation water draw not only from well bore fluid 206 in production zone 204 but also from other production zones associated with the well and system.

Well bore fluid 206 introduced into electrochemical gas lift apparatus 300 starts flowing generally in an uphole direction along with production fluid produced downhole (dotted arrow 220). The drive is due to differential pressure between the surface and conditions downhole.

The interior of electrochemical gas lift apparatus 300 contain two opposing plates: anode plate 314 and cathode plate 316. Anode plate 314 and cathode plate 316, upon the introduction of electrical power, operate to produce an electrical potential in well bore fluid 206 located between anode plate 314 and cathode plate 316. Anode power conduit 318 and cathode power conduit 320 separately couple and supply power to anode plate 314 and cathode plate 316, respectively. Insulated supports 322 offset each anode plate 314 and cathode plate 316 from interior wall 324 to prevent electrical grounding. Interior wall 324 includes electrically resistant coating 326 that insulates interior wall 324 from the electrical potential generated by anode plate 314 and cathode plate 116. Anode power conduit 318 and cathode power conduit 320 enter electrochemical gas lift apparatus 300 through insulated supports 322.

Upon application of electrical power, the electrical potential is generated. At least a portion of the formation water in well bore fluid 206 converts into product gas hydrogen and oxygen. The product gas forms product gas bubbles 350 on each anode plate 314 and cathode plate 316 and eventually detach into well bore fluid 206. In doing so, well bore fluid 206 converts into production fluid 352, which contains hydrocarbon fluid, the unconverted formation water and product gas bubbles 350. Product gas bubbles 350 provide artificial gas lift to production fluid 352 as it approaches the surface by traversing uphole (along dotted arrow 220).

Electrochemical Gas Lift Apparatus

The electrochemical gas lift apparatus is operable to selectively permit the introduction of well bore fluid into the completion string. Examples of useful devices fur controlling the inflow of hydrocarbon-bearing fluid from the production zone into the interior of the electrochemical gas lift apparatus include inflow control valves, labyrinths and sand and grit mesh sand screens. Useful devices can manipulate, treat, prepare and filter the hydrocarbon fluid and formation water from the hydrocarbon-bearing formation before it enters the interior of the electrochemical gas lift apparatus.

The electrochemical gas lift apparatus is operable to withstand hydrocarbon-bearing fluid, formation water, salts, minerals, brine, sulfurous gases, bumping into rock formations and alkaline/acidic conditions downhole. The body of the electrochemical gas lift apparatus is made of a material that is operable at the temperatures found downhole (up to 350° C.) and is resistant to chemical attack, including halogen gases at elevated downhole temperature and pressure and the solvating effects of the hydrocarbon-rich environment. Useful materials include metal alloys like HASTELLOY (Haynes Int'l; Kokomo, Indiana), MONEL and INCONEL (Special Metals Corp.; New Hartford, N.Y.); fluoropolymers such as polytetrafluoroethylene (PFTE), perfluoroalkoxy polymers (PFA), polyether ether ketone (PEEK) polymers, fluorinated ethylene propylene polymers (FEP), polyetherimides (PEI) and ethylenetetrafluoroethylene (ETFE) polymers; carbon, stainless and low alloy steels coated or clad with fluoropolymers; fluorinated or chlorinated synthetic rubbers, silicones, and polymer gasket rings and sealants; titanium alloys; nickel alloys; and certain classes of thermosetting polymers like polyimides, polycarbonates and epoxy resins.

In an embodiment of the electrochemical gas lift apparatus, the interior wall includes an electrically resistant coating. Certain types of polymers, carbon fibers and ceramic materials are chemically resistant to acidic/alkaline hydrocarbon environments and free-radical halogens. Useful types of these materials are also electrically resistant if not virtually electrically non-conductive. Such materials are useful proximate to and coupled with the electrodes and as components in the interior of the electrochemical gas lift apparatus. Adherence of the coating or materials to the interior wall can occur through a variety of known means, including spray coating, cladding and reactive bonding.

Components contacting, separating, shielding or in close proximity to the electrodes that are at least electrically resistant are useful to prevent grounding when the electrodes are generating the electrical potential. These components can be made of the same or different materials that make the electrically resistant coating. For example, mounts that fix the location of the anode and the cathode within the interior of the electrochemical gas lift apparatus may be made of a high-density polymer that is resistant to hydrocarbon swelling. Such mounts, which provide electrical insulation between the electrode and the body of the electrochemical gas lift apparatus, may permit or be drilled through and resealed to allow exterior electrical conduit to pass through the interior wall of the electrochemical gas lift apparatus and attach to each electrode. In such a manner, the electrode can receive power and yet remain electrically insulated from the remainder of the electrochemical gas lift apparatus.

Electrodes

The electrodes couple to and are in electrical communication with a source of electrical power. The source of electrical power for the electrodes may include a variety of primary power sources, including electrical transmission systems sources, and "alternative" powers sources, including solar cells and wind turbines.

The electrochemical gas lift apparatus may have one or more pairs of electrodes. The electrode pair may be located as an electrode arrays within the interior of the electrochemical gas lift apparatus to increase the exposure surface area for product gas generation. In an embodiment of the apparatus, the anode and the cathode are located upstring of an inlet flow control valve. The inlet flow control valve is operable to selectively permit the introduction of the well bore fluid from the production zone.

An embodiment of the electrochemical gas lift apparatus includes where the electrode pair is located within the interior of the apparatus upstring of the inflow control valve. Internal housing of the electrodes protects the electrodes from the harsh physical and chemical conditions present in the production zone. Internal housing also provides protection from contacting well control fluids, the well bore wall and debris during introduction and positioning within the well bore. Locating the pair of electrodes upstring of the inlet control valve or other fluid inlet port permits the introduced well bore fluid to drive the movement of the formation water past and through the electrodes. The fluid movement facilitates both electrolysis by ensuring a continuous supply of fresh formation water and the release of the product gas bubbles from the electrodes into the newly formed production fluid.

The space between each opposing electrode is such that electrical current does not pass from one electrode to the other before inducing electrolysis in the formation water between the electrodes. The hydrocarbon fluid provides an insulating effect, and the presence of a non-conductive fluid with the formation water permits the generation of greater electrical potential between the electrodes versus an environment that is water-dominant.

The electrodes may have any shape or configuration, including bar, rod, mesh, curved, flat sheet and films. The electrodes can be porous or solid. Complex and three-dimensional geometries increase the fluid contact surface area and may improve the electrolysis efficiency. Examples of high current density electrodes include clusters of thin rods and spirals; meshes; bundles of microfibers and woven strands; wrapped and unwoven wire bundles; open-cellular structures akin to reticulated vitreous carbon (RVC); arrays of single and multi-walled tubes and cylinders, including carbon nanotubes; spheroids inside a fluidly communicative container; and high-surface area porous particles, granules and powders, including graphitized mesoporous carbons (GMCs).

Given the constraints of space within the interior of the electrochemical gas lift apparatus, an embodiment of the electrochemical gas lift apparatus includes where the electrode pair couple to one another through an electrically insulating material. The coupling must ensure that electrical current does not leak between the anode and the cathode or the electrical potential (and the means for generating product gas) is defeated. For example, an anode and a cathode, preformed into two semi-circular sheets having a radius that is less than the interior radius of the electrochemical gas lift apparatus and coupled together with an insulating polymer material, may form a ring by which well bore fluid and production fluid may flow axially between the sheets as well as between the ring and the interior wall of the electrochemical gas lift apparatus. Another example of such an electrode ring can include holes in each electrode to permit fluid flow along the length of the ring.

The electrodes may comprise a variety of known compositions, including metals, metal oxides, carbon, conductive polymers, semiconductors and ceramics. Metals include titanium, iron, copper, platinum (with iridium or rubidium for added strength), nickel, zinc, tin and stainless steel. Metal electrodes may incorporate mixed metal oxides (MMOs) to improve selectivity and longevity. Carbon-based electrodes include particle carbon, pre-treated naturally occurring graphite and artificially created graphite (for example, carbonizing petroleum coke, oil or coal tar pitch).

Ion Exchange Membrane

Figure 3:
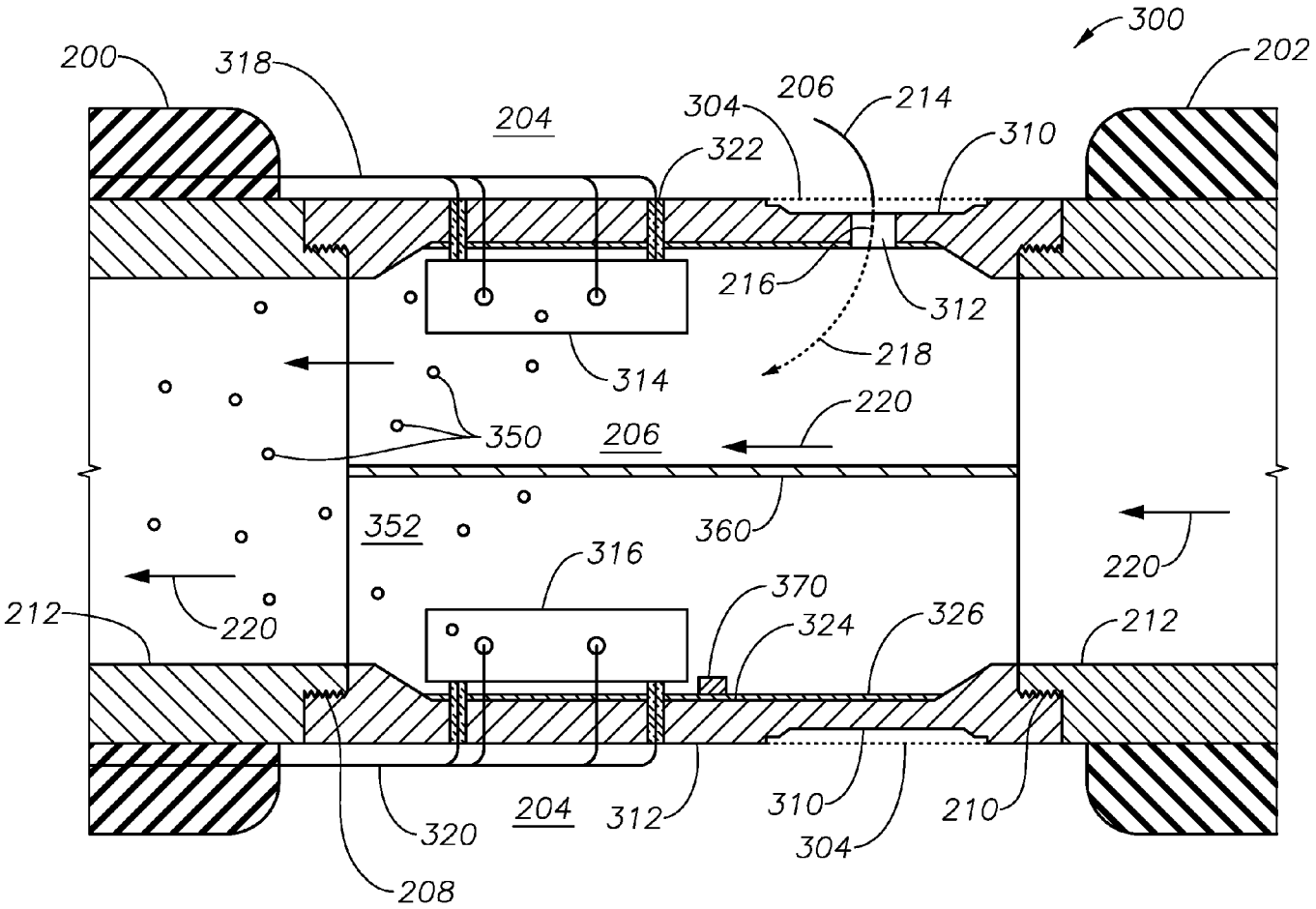
FIG. 3 shows an alternate embodiment of an electrochemical gas lift apparatus in use in a horizontal well.

An embodiment of the electrochemical gas lift apparatus includes an ion exchange membrane 360 in the interior that separates fluid between the anode and the cathode (FIG. 3). The ion exchange membrane is operable to permit only ions to pass between the electrodes. The ion exchange membrane restricts the free-flow of non-ions, including water, dissolved salts, minerals and hydrocarbons, through the membrane. Preventing unencumbered flow between the electrodes prevents the formation of undesirable reaction products that can damage the electrodes and the electrochemical gas lift apparatus.

An embodiment of the electrochemical gas lift apparatus includes an ion exchange membrane that is a cation exchange membrane. The cation exchange membrane is an ion exchange membrane that only permits one-way ion communication—cations—between the anode and the cathode. Anions cannot pass through the cation exchange membrane. An example of a cation exchange membrane includes NAFION perfluorinated materials (E. I du Pont de Nemours and Co.; Wilmington, Del.). An embodiment of the electrochemical gas lift apparatus includes an ion exchange membrane that is an anion exchange membrane.

Sensor

An embodiment of the electrochemical gas lift apparatus includes a sensor 370 that is operable to detect a condition and to transmit a signal associated with the detected condition (FIG. 3). A detectable condition includes the presence of formation water in the well bore fluid. An embodiment of the electrochemical gas lift apparatus that includes a sensor includes where the sensor is operable to detect the presence of formation water. Examples of useful sensors and data-acquisition tools include electrical resistivity/conductivity, capacitance, ultrasonic, pH, temperature and pressure indicators.

Separations System

The separations system couples to the electrochemical gas lift apparatus through the completion string. The electrochemical gas lift system produces the production fluid and introduces it into the separation system. The separation system is operable to receive the production fluid and to selectively separate the reactive gas from the production fluid. The reactive gas includes the product gas hydrogen and oxygen. The reactive gas may include other gas useful for electrical generation and often depend on the means for electricity generation. The separation system can separate light hydrocarbon gases, including methane, ethane, propane, butanes, pentanes and hexanes, for inclusion in the reactive gas. The separation system can also selectively separate carbon oxides, including carbon monoxide and carbon dioxide, for inclusion in the reactive gas. The separation system can also selectively separate hydrogen sulfide for inclusion in the reactive gas. The electrochemical gas lift system introduces the reactive gas into the electrical generation system for electricity production.

Power System and Transmission

The electrical generation system couples and is in fluid communication with the separations system (and through the separations system couples and is in fluid communication with the electrochemical gas lift apparatus). The electrical generation system is operable to produce electrical power from the introduced reactive gas. The electrical generation system is in electrical communication with the electrochemical gas lift system. The electrical generation system uses understood technologies and units, including an integrated gas turbine (IGT), a solid oxide fuel cell (SOFC) and a molten oxide fuel cell (MOFC), to convert introduced reactive as into electrical power. The electrical generation system is operable to produce sufficient electrical power such that the electrochemical gas lift apparatus provides artificial lift to the production fluid through conversion of formation water into product gas. An embodiment of the method of using an electrochemical gas lift system includes where the electrical generation system is a solid oxide fuel cell and the reactive gas comprises hydrogen, oxygen, methane, ethane, propane, butanes, pentanes, hexanes, carbon monoxide and carbon dioxide.

The electrical generation system couples to the electrodes of the electrochemical gas lift apparatus. Examples of a suitable means of coupling the electrodes to the electrochemical gas lift apparatus includes the use of shielded cable, insulated cable and wireline. The electrical power conduit can be internal or external to the completion string.

Incorporation as Part of a Completion String

The electrochemical gas lift apparatus is often used as a part of a completion string. The completion string with the electrochemical gas lift apparatus is operable to provide artificial lift to a production fluid from a production zone to a surface within the completion string. The completion string has an internal fluid conduit within the completion string that is operable to convey the production fluid from the production zone to the surface. The electrochemical gas lift apparatus includes an anode, a cathode and an interior wall. The interior wall defines an interior that contains both the anode and the cathode. The interior is operable as part of the internal fluid conduit of the completion string to convey production fluid that is produced within the electrochemical gas lift apparatus as well as production fluid produced downstring of the electrochemical gas lift apparatus. The apparatus is also operable to selectively permit the introduction of the well bore fluid from the production zone into the interior. The apparatus is also operable to convert formation water at the anode and the cathode using electrical power into product gas. The product gas converts into product gas bubbles at the electrodes. Forming product gas bubbles and converting at least a portion of the formation water converts the introduced well bore fluid into production fluid. The production fluid is artificially lifted.

An embodiment of the method includes where introduction of the electrochemical gas lift apparatus further comprises isolating a portion of the production zone fluidly from the remainder of the well bore. The completion string optionally includes inflatable or solid packers that are operable to isolate at least a portion of the production zone where hydrocarbon fluid is recovered.

Electrochemical Gas Lift Apparatus as Part of a Power Generation System

The method of using an embodiment of the electrochemical gas lift system, of which the electrochemical gas lift apparatus is part, to produce electrical power includes performing all the previously describe steps for using an electrochemical gas lift apparatus to induce artificial as lift in a production fluid.

The method also includes operating the electrochemical gas lift system such that the production fluid is produced and is introduced into a separation system. Operating the electrochemical gas lift system includes selective separating a reactive gas from the produced production fluid in the separation system. The reactive gas is introduced by the system into the electrical generation system. Operating the electrochemical gas lift system includes generating electrical power from the introduced reactive gas. At least a portion of the produced a portion of the produced electrical power is introduced to the electrochemical gas lift apparatus by the system to continue operations. An embodiment of the method includes where the combustible gas is selected from the group consisting of hydrogen, oxygen, light alkanes (methane, ethane, propane, butanes, pentanes, hexanes), carbon oxides (carbon dioxide, carbon monoxide), hydrogen sulfide and combinations thereof. The reduced pressure at the surface permits atmospheric pressure natural gases to separate from the production fluid for use as part of the reactive gas.

What is claimed is:

1. A method of using an electrochemical gas lift apparatus to induce artificial gas lift in a production fluid, the method comprising the steps of:

introducing the electrochemical gas lift apparatus into a well bore such that the electrochemical gas lift apparatus is located in the production zone of the well bore, where the well bore is defined by a well bore wall and traverses the hydrocarbon-bearing formation, where the production zone contains a well bore fluid and where the well bore fluid comprises a hydrocarbon fluid and a formation water, and wherein the electrochemical gas lift apparatus includes an anode, a cathode and an interior wall, where the interior wall defines an interior that contains both the anode and the cathode;

operating the electrochemical gas lift apparatus such that the well bore fluid is introduced into the interior of the electrochemical gas lift apparatus;

introducing electrical power to the electrochemical gas lift apparatus such that a portion of the formation water in the well bore fluid in the interior of the electrochemical gas lift apparatus is converted into a product gas, where the product gas includes hydrogen gas and oxygen gas; and operating the electrochemical gas lift apparatus such that the product gas forms product gas bubbles and the production fluid forms, where the production fluid comprises hydrocarbon fluid, unconverted formation water and product gas bubbles, and where the product gas bubbles induce artificial gas lift in the production fluid.

2. The method of claim 1 where introduction of the electrochemical gas lift apparatus further comprises isolating a portion of the production zone fluidly from a remainder of the well bore.

3. The method of claim 1 where the electrochemical gas lift apparatus is part of a completion string and the product gas bubbles induce artificial gas lift in the production fluid within the completion string.

4. A method of using an electrochemical gas lift system to produce electrical power from a production fluid comprising the steps of:

introducing the electrochemical gas lift apparatus into a well bore such that the electrochemical gas lift apparatus is located in the production zone of the well bore, where the well bore is defined by a well bore wall and traverses the hydrocarbon-bearing formation, where the production zone contains a well bore fluid and where the well bore fluid comprises a hydrocarbon fluid and a formation water;

operating the electrochemical gas lift apparatus such that the well bore fluid is introduced into an interior of the electrochemical gas lift apparatus;

introducing electrical power to the electrochemical gas lift apparatus such that a portion of the formation water in the well bore fluid in the interior of the electrochemical gas lift apparatus is converted into a product gas, where the product gas include hydrogen gas and oxygen gas; and operating the electrochemical gas lift apparatus such that the product gas forms product gas bubbles and the production fluid forms, where the production fluid comprises hydrocarbon fluid, unconverted formation water and product gas bubbles, and where the product gas bubbles induce artificial gas lift in the production fluid;

operating the electrochemical gas lift system such that the production fluid is produced and is introduced into a separation system, a reactive gas is selectively separated from the production fluid in the separation system and is introduced into an electrical generation system, electrical power is produced from the reactive gas in the electrical generation system and at least a portion of the produced electrical power is introduced to the electrochemical gas lift apparatus;

where the electrochemical gas lift apparatus, the separation system and the electrical generation system couple and are in fluid communication with each other, and where the electrochemical gas lift apparatus and the electrical generation system are in electrical communication with one another.

5. The method of claim 4 where the reactive gas is selected from the group consisting of hydrogen, oxygen, methane, ethane, propane, butanes, pentanes, hexanes, carbon monoxide, carbon dioxide, hydrogen sulfide and combinations thereof.

6. The method of claim 4 where the electrical generation system includes a solid oxide fuel cell and the reactive gas comprise hydrogen, oxygen, methane, ethane, propane, butanes, pentanes, hexanes, carbon monoxide and carbon dioxide.

7. A completion string that is operable to provide artificial lift to a production fluid from a production zone to a surface within the completion string, the completion string comprising:

an internal fluid conduit within the completion string that is operable to convey the production fluid from the production zone to the surface, and an electrochemical gas lift apparatus, where the electrochemical gas lift apparatus:

comprising an anode, a cathode and an interior wall, where the interior wall defines an interior that contains both the anode and the cathode and that is operable as part of the internal fluid conduit of the completion string to convey production fluid;

that is operable to selectively permit the introduction of a well bore fluid from the production zone into the interior, where the well bore fluid comprises a hydrocarbon fluid and a formation water; and that is operable to convert the formation water at the anode and the cathode using electrical power into product gas, to convert product gas into product gas bubbles, and to convert the introduced well bore fluid into production fluid, where the production fluid comprises hydrocarbon fluid, unconverted formation water and product gas bubbles, such that the production fluid is artificially lifted.

8. The completion string of claim 7 where the anode and the cathode are located upstring of an inlet flow control valve that is operable to selectively permit introduction of the well bore fluid from the production zone.

9. The completion string of claim 7 where the interior wall includes an electrically resistant coating.

10. The completion string of claim 7 where the electrochemical gas lift apparatus further comprises an ion exchange membrane in the interior that separates fluid between the anode and the cathode.

11. The completion string of claim 10 where the ion exchange membrane is a cation exchange membrane.

12. The completion string of claim 7 where the electrochemical gas lift apparatus further comprises a sensor that is operable to detect a condition and to transmit a signal associated with the detected condition.

13. The completion string of claim 12 where the detectable condition is a presence of the formation water in the well bore fluid.

* * * * *